US008601625B2

(12) United States Patent
Moschütz

(10) Patent No.: US 8,601,625 B2
(45) Date of Patent: Dec. 10, 2013

(54) METHOD FOR CONTROLLING THE GENERATION OF SUDS IN A WASHING MACHINE AND A WASHING MACHINE SUITABLE THEREFOR

(75) Inventor: Harald Moschütz, Groβbeeren (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 974 days.

(21) Appl. No.: 12/668,447

(22) PCT Filed: Jul. 9, 2008

(86) PCT No.: PCT/EP2008/058897

§ 371 (c)(1),
(2), (4) Date: Jan. 11, 2010

(87) PCT Pub. No.: WO2009/010432

PCT Pub. Date: Jan. 22, 2009

(65) Prior Publication Data

US 2010/0192310 A1 Aug. 5, 2010

(30) Foreign Application Priority Data

Jul. 18, 2007 (DE) ..... 10 2007 033 492

(51) Int. Cl.
*D06F 39/00* (2006.01)

(52) U.S. Cl.
USPC ..... 8/158; 68/12.19

(58) Field of Classification Search
USPC ..... 8/137, 158–159; 68/139, 17 R, 12.19
See application file for complete search history.

(56) References Cited

U.S. PATENT DOCUMENTS 4,054,412 A * 10/1977 Brummett et al. ..... 8/158
4,118,189 A 10/1978 Reinwald et al.
5,038,586 A 8/1991 Nukaga et al.
5,890,247 A * 4/1999 Erickson et al. ..... 8/158

(Continued)

FOREIGN PATENT DOCUMENTS

DE 3638498 A * 5/1988
DE 3638498 A1 5/1988

(Continued)

OTHER PUBLICATIONS

JPO English abstract of JP 2003-000892 A.*

(Continued)

*Primary Examiner* — Michael Kornakov
*Assistant Examiner* — Kevin G Lee
(74) *Attorney, Agent, or Firm* — James E. Howard; Andre Pallapies

(57) ABSTRACT

A washing machine includes a program controller for controlling a program sequence, a drum rotatably supported in a tub, a liquor drain system on a floor of the tub, a liquor drain pump, a drive motor for driving the drum, a heater, a sensor for determining an amount of liquid or of suds in the tub that sense a hydrostatic pressure, a time gradient of the hydrostatic pressure, and/or a guide value in the tub or the drum, and a switch for rotating and stopping the drum and for increasing the speed of the drum if the hydrostatic pressure is less than a predetermined value and for decreasing the speed of the drum if the hydrostatic pressure is more than another predetermined value.

14 Claims, 1 Drawing Sheet

(56) References Cited

U.S. PATENT DOCUMENTS

| | | | | |
|---|---|---|---|---|
| 6,269,506 | B1 * | 8/2001 | Hollatz et al. | 8/158 |
| 7,340,792 | B2 * | 3/2008 | Czyzewski et al. | 8/158 |
| 8,220,092 | B2 * | 7/2012 | Schulze | 8/159 |
| 2005/0197264 | A1 * | 9/2005 | Czyzewski et al. | 510/137 |

FOREIGN PATENT DOCUMENTS

| | | | | |
|---|---|---|---|---|
| DE | 3703917 | A | * | 8/1988 |
| DE | 3703917 | A1 | | 8/1988 |
| DE | 3840265 | A | * | 5/1990 |
| DE | 4104151 | A | * | 8/1992 |
| DE | 4104151 | A1 | | 8/1992 |
| DE | 4334969 | A1 | | 4/1994 |
| DE | 4342274 | A1 | * | 6/1995 |
| DE | 19606769 | A1 | * | 8/1997 |
| DE | 19839896 | A1 | | 3/2000 |
| DE | 19846248 | A1 | * | 4/2000 |
| DE | 10234472 | A1 | * | 2/2004 |
| EP | 0268155 | A2 | | 5/1988 |
| EP | 0278239 | A1 | | 8/1988 |
| EP | 0724036 | A1 | | 7/1996 |
| EP | 724036 | A1 | * | 7/1996 |
| EP | 1719832 | A1 | * | 11/2006 |
| JP | 2003000982 | A | * | 1/2003 |
| KR | 2001045063 | A | * | 6/2001 |
| WO | 2007074037 | A1 | | 7/2007 |
| WO | WO 2007074037 | A1 | * | 7/2007 |

OTHER PUBLICATIONS

Machine translation of EP0268155.*

* cited by examiner

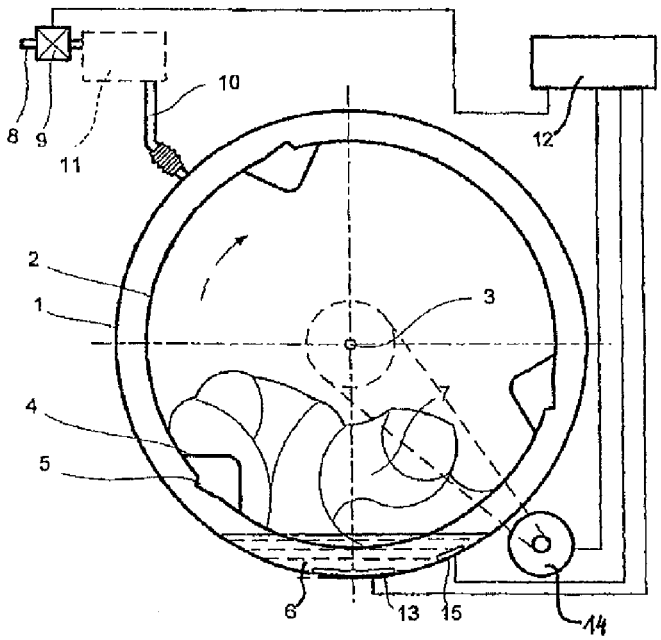
8
9
11
10
12
2
1
3
7
4
5
6
13
15
14

METHOD FOR CONTROLLING THE GENERATION OF SUDS IN A WASHING MACHINE AND A WASHING MACHINE SUITABLE THEREFOR

BACKGROUND OF THE INVENTION

The invention relates to a method for controlling the generation of suds in a washing machine, especially during the treatment of washing with suds in a program-controlled washing machine, as well as to a washing machine especially suitable for carrying out this method.

With known washing methods the laundry to be washed is simply mixed with a quantity of water or washing liquid, also known as "liquor", which is sufficient for the laundry to be washed to be saturated with water and for a minimum of free washing liquor, generally 2 to 3 liters, to make possible an exchange of material between the heater for warming the washing liquor and the laundry. The free liquor corresponds to that residue of the washing liquor that is not bound by the laundry and is thus present as liquid. The corresponding dimensioning of the quantity of water of washing liquor is ensured by a suitable method for regulating the water level in the drum and adapting the quantity of water to the absorption capability of the laundry. The free liquor is produced after subtracting the quantity of water bound into the laundry from the quantity of water with which the washing machine is filled. Woolen fabric binds around 200% of its own weight, so that a load of 6 kg or woolen fabric binds in around 12 liters of water.

The energy consumption of a washing machine is essentially determined by the energy needed for heating up the water. A reduction in the amount of water would thus be desirable, especially a reduction in the amount of free liquor. However the free liquor must guarantee the transport of heat from the heater into the laundry. A reduction in the liquor and thereby a reduction in the energy consumption are thus difficult to achieve.

An alternative to this known washing method is washing with suds which can be generated by adding mechanical energy into the washing liquor. In such cases the suds take over the heating up and cleaning of washing to be cleaned.

To achieve a sufficient energy transport from the heating device in a washing machine into the washing it is necessary to develop sufficient suds. Because of the lower heat capacity of suds compared to the heat capacity of a washing liquor there would otherwise be the danger of the heating device overheating. However, if too many suds are generated, there is the danger of the suds escaping from the washing machine, especially from its dispensing compartment. In addition it should be noted that the development of suds depends on a large number of parameters. Some of the parameters can be influenced by a program-controlled washing machine by a corresponding design of the appropriate washing programs (for example temperature, amount of water, speed of the drum). Type and quantity of laundry as well as the detergents (tensides and further substances) as well as water hardness and degree of contamination on the other hand are not able to be influenced by a washing machine and are subject to unpredictable fluctuations from application to application.

DE 43 34 969 A1 describes a device for generating washing suds in a washing machine with a rotatable drum in a tub, having a facility for generating hot air which is introduced by a inlet feed in the tub wall between the tub and the drum.

In accordance with publication DE 41 04 151 A1, undesired suds occurring in a washing machine are destroyed by switching on a heating device. In order to also destroy the suds further away from the heating device, the drum is turned slowly, so that further suds reach the heating device and are destroyed there by being heated up.

In addition methods are known from DE 102 34 472 A1 and also DE 198 46 248 A1 for removing suds in a tub of a drum washing machine.

DE 102 34 472 A1 discloses a method for removing suds in a tub of an electronically controlled drum washing machine as a result of a program step provided for draining water from the tub, with a liquor draining system arranged on the floor of the tub with a liquor pump and with a sensor for determining the level of fluid to be found in the tub. The curve of the sensor signal (P) which is recorded during the operation of the liquor pump contains a gradient $\Delta p_n/\Delta t_n$ by comparison with $\Delta p_{n-1}/\Delta t_{n-1}$, which indicates the presence of suds, whereupon a suds handling measure matched to the gradient is initiated.

In EP 0 278 239 A1 a disproportionate suds formation in the main washing process, which is to be observed during heating of washing liquor in the tub, is removed by adding a restricted amount of cold water by temporarily disconnecting the liquor heater.

EP 0 268 155 A2 describes a washing machine with a facility for preventing the formation of foam. To this end a washing machine with a so called foam preventer is proposed, with the speed of a washing drum drive motor being reduced until such time as the foam limit has returned to below a specific low level, which is then permanently maintained.

BRIEF SUMMARY OF THE INVENTION

The object of the invention is to provide a method for controlling the generation of suds, especially during treatment of laundry with suds, in a program-controlled washing machine as well as to provide a washing machine especially suited to carrying out this method.

Inventively this object is achieved by a method with the features of the exemplary embodiments of a washing machine disclosed herein. Preferred embodiments of the method correspond to preferred embodiments of the washing machine and vice versa, even if this is not explicitly stated.

The object of the invention is thus a method for controlling the generation of suds, especially during treatment of laundry with suds, from an aqueous washing liquor in a program-controlled washing machine with a liquor drainage system arranged on the floor of the tub with a liquor pump, a rotating drum and a heater, with the method comprising the steps a) Detection of suds located in the tub and/or in the drum, and b) Setting and/or maintaining a range predetermined from $c_1$ to $c_2$ for the concentration of the suds, with the detection (a) of the suds being undertaken by means of one or more sensors which follow a hydrostatic pressure p, a time gradient ($\Delta p/\Delta t$) of the hydrostatic pressure p, and/or a guide value k in the tub and/or in the drum, and with a measured hydrostatic pressure p being compared with a predetermined lower value $p_1$ for the hydrostatic pressure and a predetermined upper value $p_2$ for the hydrostatic pressure, and for the case $$p<p_1$$

the speed U of the drum (2) being increased, and for the case $$p>p_2$$

the speed U of the drum (2) being decreased.

The detection of suds can thus for example be undertaken by measuring a guide value with two electrodes in the lower area of the tub.

In addition a pressure generator used in any event in a known washing machine as a water level control can be used as a sensor. When measuring the hydrostatic pressure it is advantageous for a marked increase in the pressure to be measured if, during rotation of the drum, especially during spinning, a gap between the drum and the tub is completely filled with suds.

In the event of $p>p_2$, a1) the speed U of the drum (2) is preferably reduced by a predetermined speed difference $\Delta U_1$, a2) after a predetermined period $\Delta t$ the pressure p is measured and it is established whether the relationship $p \leq p_2$ is fulfilled, and a3) if it still applies that $p>p_2$, the speed U is reduced by $\Delta U_n$, (n is a natural number≥2), and steps a2) and a3) are repeated (n−1) times, until a predetermined value $U_{min}$ is reached or undershot, In the event of $p<p_1$ b1) the speed U of the drum (2) is preferably reduced by a predetermined speed difference $\Delta U_1$, b2) after a predetermined time $\Delta t$ the pressure p is measured again and it is established whether the relationship $p \geq p_1$ is fulfilled, and b3) if it still applies that $p<p_1$, the speed U is increased by $\Delta U_m$ (m is a natural number>2), and steps b2) and b3) are repeated (m−1) times, until a predetermined value $U_{max}$ is reached or undershot.

In this case m and n can be the same or different. In addition the speed differences $\Delta U_n$, or $\Delta U_m$ can each be the same or different.

The effect of increasing the speed of the drum is that more water or suds is spun out of the washing. This increases the water level on a floor of the tub. As a result the interaction between this water and the rotating drum is increased. In addition the more intensive mechanical interaction caused by the higher drum speed also leads to an intensification of the development of the suds.

By contrast a lowering of the speed of the drum leads, for an undersaturated laundry item, i.e. with a laundry item which has less water than it could hold or bind for complete saturation of the washing with water for the current speed of the tub, to the water being absorbed by the washing item and thus the amount of water in the gap between the drum and the tub being reduced. In addition the reduced mechanical interaction reduces the generation of suds.

If in the inventive method the speed U has reached or undershot the predetermined value $U_{min}$ preferably a4) the rotation of the drum is ended;

a5) more water is supplied;

a6) the drum is switched over into a reversing mode, and/or a7) an indication is given that the detergent dose present is too high or incorrect.

If in the inventive method the speed U has reached or undershot the predetermined value $U_{max}$, preferably b4) the rotation of the drum is ended;

b5) more water is supplied; and/or b6) an indication is given that the detergent dose present is too low.

It is further preferred in the last two preferred embodiments that, in step a5) or b5), the amount of water supplied is such that a normal washing process with a washing liquor without suds is made possible and this washing method is executed.

The indication that there is too little (b6) or too much or an incorrect dose of detergent (a7) is preferably an acoustic and/or optical indication.

If however the desired range for the development of suds cannot be achieved, despite utilization of an available range of adjustment for the speed of the drum, a signal can be output to a control device of the washing machine which initiates further steps. If for example, despite a maximum speed of the drum (also referred to as the maximum spin speed) it is not possible to generate sufficient suds, the washing process can be continued after adding water up to the usual level as a conventional washing process. An acoustic or visual signal can be output in this case for the user of the washing machine about the missing or insufficient supply of detergent.

If on the other hand so many suds are generated that, despite a minimum speed of the drum, the concentration of suds (also referred to as the suds level) is too high (e.g. if the user has added to much detergent or a detergent for hand washing or for wool with no restriction on the suds) the washing process can likewise be continued as a conventional washing process after addition of water up to the usual level. An acoustic or visual signal can be output in this case for the user of the washing machine about the detergent level being incorrect or too high.

After step a4) and/or a6) have been carried out for a predetermined period the inventive method can be carried out again.

Thus for example a strong rotation (spinning) of the drum can be switched off and a switchover can be made for a predetermined time to a normal reversing operation of the drum. This supports the absorption of the water in the suds state by the laundry items and thereby effectively reduces the amount of suds. During reversing a drain pump can also be switched on in order to reduce the amount of water in the tub and available for generation of suds. Subsequent to this absorption of the suds a fresh attempt can be made to switch over to spinning and, on setting a desired suds concentration, to carry out a washing process based on suds.

When the inventive method is carried out the drum preferably rotates at a speed U ranging from 200 to 600, preferably from 230 to 500 revolutions per minute. In this case the lower limit is generally given by the resonance speed of the suspension system and the upper limit by the maximum possible spin speed.

During the inventive method the heater generally heats up the suds and/or the washing liquor.

As an alternative or in addition to the method already described, an evaluation of a required/actual speed difference ($U_{req}-u_{act}$) is included for a rotation of the drum for detection (a) of the suds. On detection of suds using an evaluation of the required/actual difference, especially during spinning, use is made of the situation that the suds can slow down a rotating drum, which produces a difference between the required and the actual speed. In this case the assignment between a specific suds concentration and the required/actual difference is generally stored in a data memory of the drum washing machine.

A desired concentration cv of the suds which is predetermined in the range $c_1$ to $c_2$ can be set and/or maintained by a continuous change of the speed U of the drum.

Preferably the concentration c corresponds to the hydrostatic pressure $p_1$ and the concentration $c_2$ to the hydrostatic pressure $p_2$.

The object of the invention is also a washing machine with a programmed controller for controlling the program sequence, a drum supported rotatably in a tub, a liquor drainage system arranged on the floor of the tub with a drain pump, a drive motor for the drum, a heater device, a sensor for determining an amount of liquid located in the tub or of suds and switching means for rotating and stopping the drum, with the switching means and the sensor being able to carry out the inventive method described herein.

When the inventive method for controlling the generation of suds has achieved the setting and maintenance of a desired concentration of sites, the treatment of a laundry item with suds can be carried out.

This can be undertaken by a method for the treatment of laundry with aqueous washing liquor in the program controlled washing machine with a liquor drain system arranged on the floor of a tub with a drain pump, a heater device, a sensor for determining the amount of liquid or of suds located in the tub, with a sensor signal being followed during the method and a drum with a specific comparatively small amount of water related to a load quantity of laundry.

The invention makes possible the stable operation of washing machine for a washing method which employs suds. A desired generation of suds is promoted and the generation of too many suds is simultaneously prevented. The invention also ensures sufficient cooling off the heating device of a washing machine and can prevent the heating device being switched on if sufficient suds have not been generated.

BRIEF DESCRIPTION OF THE DRAWINGS

An exemplary embodiment of washing machine in accordance with the invention for carrying out the method is shown in FIG. 1. Other embodiments are conceivable. The exemplary embodiment is explained below.

FIG. 1 is a schematic diagram of those parts of a washing machine in which the described method can be carried out that are relevant for the explanation. The washing machine of the exemplary embodiment shown in FIG. 1 features a tub 1 in which a drum 2 is rotatably supported and can be driven by a drive motor 14. In respect of ergonomics when using such a washing machine, the axis of rotation 3 of the drum 2 is inclined upwards from the horizontal to the front by a small angle (e.g. 13°) to provide easier access and a view into the inside of the drum 2. Through this arrangement in conjunction with specially shaped laundry agitators 4 and feed devices 5 for the washing liquor 6 on the inner surface of the drum casing, an intensification of the flooding of the laundry 7 with washing liquor and suds and a reduction of the free liquor is also achieved.

DETAILED DESCRIPTION OF EXEMPLARY EMBODIMENTS OF THE PRESENT INVENTION

The suds formed during a washing method with suds should especially fill out a space between the drum 2 and the tub 1.

The washing machine has a liquor feed system which comprises a water connection tap for the domestic water network 8, an electrically controllable valve 9 and a feed pipe at 10 to the tub 1, which if necessary can also be routed via a detergent supply facility (detergent dispenser drawer) 11 from which the inlet water can transport portions of detergent into the tub. In addition there is a heater device 13 in the tub 1. The valve 9 and also the heater device 13 can be controlled by a control device (program controller) 12 as a function of a program scheduler. The control device 12 in particular receives the values measured by a sensor 15 for the hydrostatic pressure p in the tub 1 which are included for changing or maintaining a speed of the drum 2. To this end the drive motor 14 is controlled via the control device 12.

The invention claimed is:

1. A washing machine, comprising:

a program controller for controlling a program sequence;

a drum rotatably supported in a tub;

a liquor drain system on a floor of the tub;

a liquor drain pump;

a drive motor for driving the drum;

a heater;

a sensor for determining an amount of liquid or of suds in the tub that sense a hydrostatic pressure, a time gradient of the hydrostatic pressure, and/or a guide value in the tub or the drum; and a switch for rotating and stopping the drum and for increasing the speed of the drum if the hydrostatic pressure is less than a predetermined lower value in order to increase a concentration of the suds in the tub to within a predetermined range, and for decreasing the speed of the drum if the hydrostatic pressure is more than a predetermined upper value in order to decrease the concentration of the suds in the tub to within the predetermined range, the predetermined lower value being different than the predetermined upper value to define the range of concentration, the program controller programmed to control the switch to rotate and stop the drum and to increase the speed of the drum if the hydrostatic pressure is less than the predetermined lower value in order to increase the concentration of the suds in the tub to within the predetermined range, and to decrease the speed of the drum if the hydrostatic pressure is more than the predetermined upper value in order to decrease the concentration of the suds in the tub to within the predetermined range.

2. A method for treatment of laundry with suds from an aqueous washing liquor in a program-controlled washing machine with a liquor drain system arranged on the floor of a tub with a liquor pump, a rotating drum and a heating device, the method comprising:

detecting suds in the tub or the drum by a sensor that follows a hydrostatic pressure, a time gradient of the hydrostatic pressure, and/or a guide value in the tub and/or in the drum; and setting or maintaining a range of concentration of the suds in the tub or the drum by increasing a speed of the drum if a measured hydrostatic pressure is less than a predetermined lower value for a hydrostatic pressure in order to increase the concentration of the suds in the tub or the drum to within the range, and decreasing the speed of the drum if the measured hydrostatic pressure is greater than a predetermined upper value for the hydrostatic pressure in order to decrease the concentration of the suds in the tub or the drum to within the range, wherein the suds are present in the tub or the drum throughout the range, the predetermined lower value being different than the predetermined upper value to define the range of concentration.

3. The method of claim 2, wherein, if the measured hydrostatic pressure is greater than the predetermined upper value for the hydrostatic pressure, then the decreasing of the speed comprises:

decreasing the speed of the drum by a predetermined speed difference;

measuring the hydrostatic pressure;

decreasing the speed of the drum by another predetermined speed difference if the measured hydrostatic pressure is greater than the predetermined upper value; and repeating the measuring and decreasing until the measured hydrostatic pressure is less than or equal to a predetermined value.

4. The method of claim 3, further comprising, if the speed of the drum is equal to or less than a predetermined minimum speed:

ending the rotation of the drum;

introducing more water;

switching the drum to a reverse mode; and/or indicating that the detergent dose is too high or incorrect.

5. The method of claim 4, wherein the introducing of more water comprises supplying an amount of water that makes possible a normal washing method with a washing liquor without suds and further comprising washing with the normal washing method.

6. The method of claim 2, wherein, if the measured hydrostatic pressure is less than the predetermined lower value for the hydrostatic pressure, then the increasing of the speed comprises:

increasing the speed of the drum by a predetermined speed difference;

measuring the hydrostatic pressure after a predetermined delay;

increasing the speed of the drum by another predetermined speed difference; and repeating the measuring and increasing until the hydrostatic pressure is greater than or equal to a predetermined value.

7. The method of claim 6, further comprising, if the speed of the drum is equal or greater than a predetermined maximum speed:

ending the rotation of the drum;

introducing more water; and/or indicating that the detergent dose is too low.

8. The method of claim 7, wherein the introducing of more water comprises supplying an amount of water that makes possible a normal washing method with a washing liquor without suds and further comprising washing with the normal washing method.

9. The method of claim 7, wherein the indicating is given acoustically and/or optically.

10. The method of claim 2, wherein, during the setting or maintaining the range of concentration of the suds in the tub or the drum, the drum turns at a speed ranging from 200 to 600 revolutions per minute.

11. The method of claim 2, further comprising heating up the suds and/or the washing liquor with a heater.

12. The method of claim 2, wherein the detecting of the suds further comprises evaluating a required/actual speed difference for a rotation of the drum.

13. The method of claim 2, wherein the setting or maintaining of the concentration of the suds comprises a continuous changing of the speed of the drum.

14. The method of claim 2, wherein the range of concentration of suds corresponds to a range of hydrostatic pressures.

* * * * *